US009010254B1

(12) United States Patent
Kyler

(10) Patent No.: US 9,010,254 B1
(45) Date of Patent: Apr. 21, 2015

(54) DOOR BLOCKING DESK

(71) Applicant: Daniel W. Kyler, Runnemede, NJ (US)

(72) Inventor: Daniel W. Kyler, Runnemede, NJ (US)

( * ) Notice: Subject to any disclaimer, the term of this patent is extended or adjusted under 35 U.S.C. 154(b) by 0 days.

(21) Appl. No.: 14/045,965

(22) Filed: Oct. 4, 2013

(51) Int. Cl.

| | |
|---|---|
| ***A47F 5/12*** | (2006.01) |
| ***A47B 41/02*** | (2006.01) |
| ***E06B 7/28*** | (2006.01) |
| ***E06B 5/10*** | (2006.01) |
| ***F41H 5/06*** | (2006.01) |
| ***A47B 13/00*** | (2006.01) |

(52) U.S. Cl.
CPC . *A47B 41/02* (2013.01); *E06B 7/28* (2013.01); *E06B 5/10* (2013.01); *F41H 5/06* (2013.01); *A47B 13/003* (2013.01)

(58) Field of Classification Search
CPC ..... A47B 23/02; A47B 23/046; A47B 27/00; A47B 3/00; A47B 13/081; F25D 2325/023
USPC ..... 108/5, 6, 8, 115, 137; 312/309–310; 49/380, 463
See application file for complete search history.

(56) References Cited

U.S. PATENT DOCUMENTS

| | | | | |
|---|---|---|---|---|
| 1,200,071 | A * | 10/1916 | Barler | 312/230 |
| 1,506,348 | A | 8/1924 | Kamin | |
| 1,792,993 | A * | 2/1931 | Lochner | 108/8 |
| 3,152,848 | A | 10/1964 | Kalk | |
| 4,016,819 | A | 4/1977 | Cowling | |
| 4,431,239 | A | 2/1984 | Vainikka | |
| 4,643,105 | A | 2/1987 | Baum | |
| 4,879,954 | A * | 11/1989 | Sawamura et al. | 108/6 |
| 4,955,294 | A * | 9/1990 | Abe | 108/6 |
| 4,986,195 | A * | 1/1991 | Diffrient | 108/150 |
| 5,172,641 | A * | 12/1992 | Auer | 108/5 |
| 6,336,414 | B1 * | 1/2002 | Stewart et al. | 108/50.02 |
| 6,354,227 | B1 * | 3/2002 | Feldpausch et al. | 108/50.11 |
| 2010/0095565 | A1 * | 4/2010 | Ma et al. | 38/103 |
| 2012/0152096 | A1 | 6/2012 | Peters | |

* cited by examiner

*Primary Examiner* — Matthew Ing
(74) *Attorney, Agent, or Firm* — Norman E. Lehrer

(57) ABSTRACT

A door blocking desk or table includes a substantially rectangular frame having two sides, two ends and having four corners with legs extending downwardly from each corner to support the frame on the floor. A rectangular bullet-proof top is supported on the frame and is pivotable between a first position where it is horizontal and lying on the frame and a second position wherein it lies in a substantially vertical plane in substantial alignment with one of the frame ends. The entire desk is movable toward a doorway so that the upper surface of the top can block the doorway when the top is in its second vertical position and slide bolts or other locking members carried on the undersurface of the top lock the top to the door frame to prevent persons or bullets from passing through.

5 Claims, 3 Drawing Sheets

DOOR BLOCKING DESK

BACKGROUND OF THE INVENTION

The present invention is directed toward a door blocking desk or table and, more particularly, toward such a piece of furniture that can be easily moved into place in a doorway of a school room or the like and that can be locked in place to prevent a person or a bullet from getting through.

Unfortunately, in our society today there is a growing need for methods of self protection particularly against persons with guns. Gun violence over the past number of years has increased significantly. Mass shootings, in particular, have become prevalent.

Tragically, many mass shootings have occurred in schools and, most recently, in an elementary school where numerous innocent young children were killed and numerous others injured.

Several proposals have been set forth to prevent such mass killings. U.S. Patent Application Publication No. 2012/0152096 to Peters, for example, shows various articles of furniture including school desks and office furniture that are constructed of bullet-proof material allowing a student or teacher to hide under the desk for protection. Unfortunately, once a gunman enters a room it may be too late for the children to protect themselves.

There have also been proposals for automatically locking doors or making it easy to close and blockade a door. Insofar as Applicant is aware, such proposals have not been accepted since it would be easy for a gunman to shoot through a door or otherwise break down an entrance door.

There is, therefore, a need for an arrangement that would allow a teacher or even students to quickly and easily blockade a door to the classroom and which would provide protection to the students therein.

SUMMARY OF THE INVENTION

The present invention is designed to overcome the deficiencies of the prior art discussed above. Accordingly, it is an object of the present invention to provide a door blocking desk or table that is effective in preventing someone from passing through the doorway.

It is a further object of the present invention to provide a door blocking desk that can be easily moved into position and locked in place.

It is a still further object of the invention to provide a door blocking desk that not only prevents a person from passing through a doorway but also prevents bullets from passing therethrough.

In accordance with the illustrative embodiments demonstrating features and advantages of the present invention, there is provided a door blocking desk or table that includes a substantially rectangular frame having two sides, two ends and four corners with legs extending downwardly from each corner to support the frame on the floor. A rectangular bullet-proof top is supported on the frame and is pivotable between a first position where it is horizontal and lying on the frame and a second position wherein it lies in a substantially vertical plane in substantial alignment with one of the frame ends. The entire desk is movable toward a doorway so that said upper surface of the top can block said doorway when the top is in its second vertical position and slide bolts or other locking members carried on the undersurface of the top lock the top to the door frame to prevent persons or bullets from passing through.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
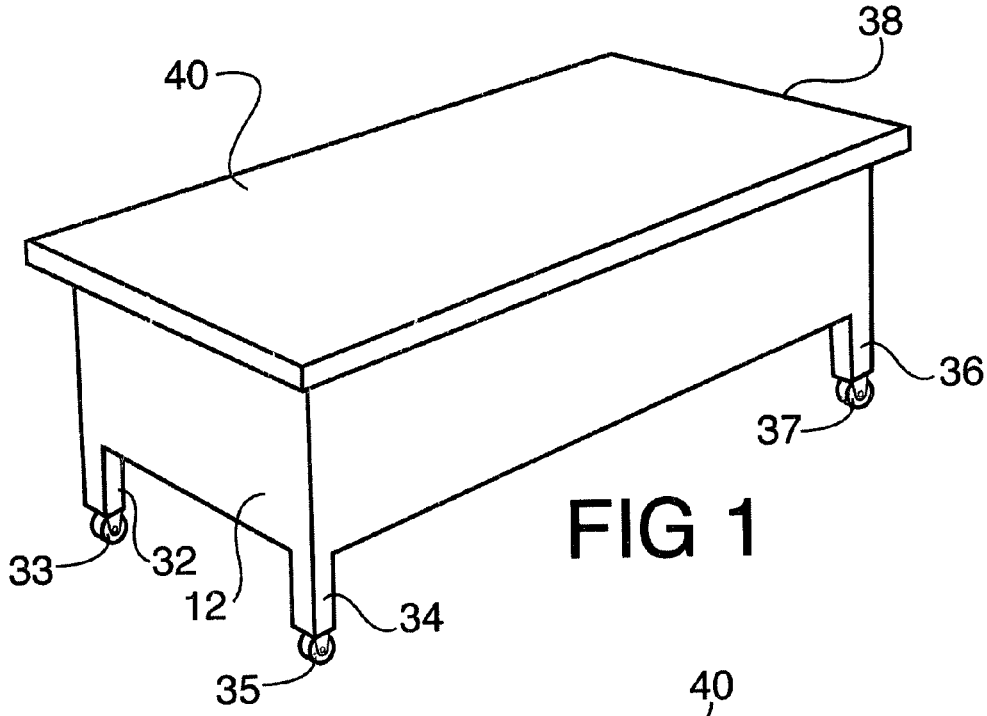
FIG. 1 is a front top perspective view of the table or desk of the invention.
Figure 2:
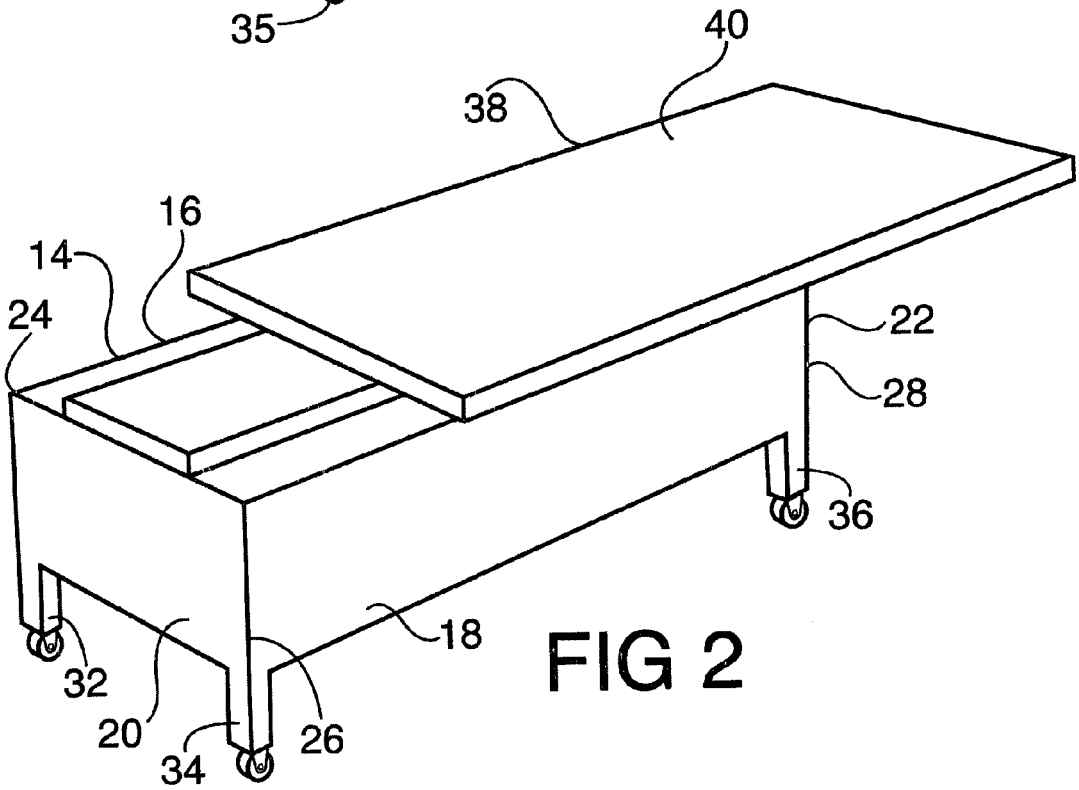
FIG. 2 is a view similar to FIG. 1 but showing how the top is slid to one end before it is pivoted up in a first embodiment of the invention.
Figure 3:
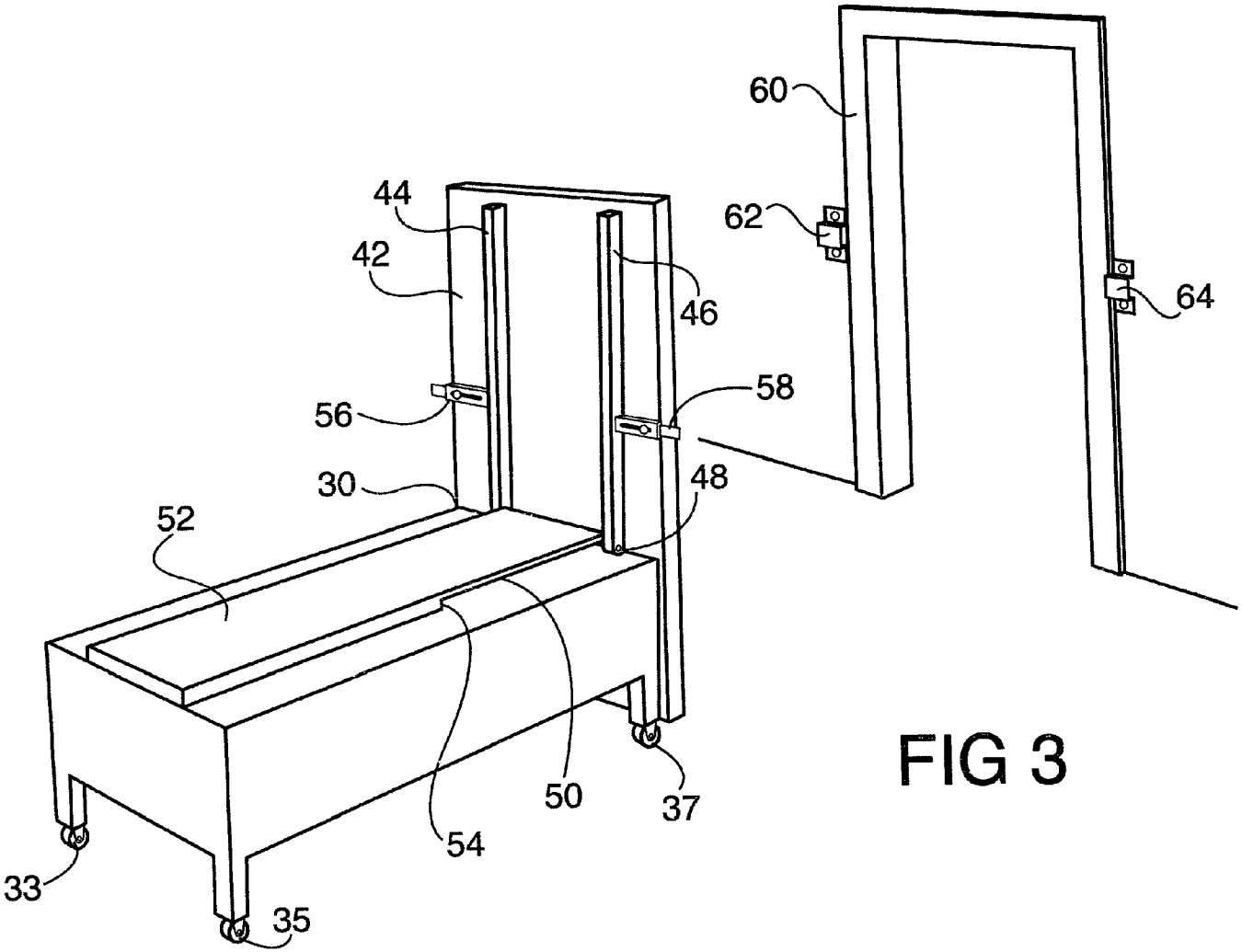
FIG. 3 is a front top perspective view of the desk top of the first embodiment of the invention in its vertical blocking position and illustrating how it can be moved into a doorway to block the same.

Referring now to the drawings in detail wherein like reference numerals have been used throughout the various figures to designate like elements, there is shown in FIGS. 1-3 a first embodiment of a door blocking desk constructed in accordance with the principals of the present invention and designated generally as 10. The desk 10 includes a substantially rectangularly shaped frame 12 having an upper portion 14, two sides 16 and 18 and two ends 20 and 22. The frame 12 also includes four corners 24, 26, 28 and 30. (FIG. 3)

Extending downwardly from each of the corners is a leg such as shown at 32, 34 and 36. The legs obviously support the frame on the floor. Although not necessary in all environments, the legs may include rollers or wheels 33, 35 and 37 or the like at the bottom of each of the legs to make it easier to move the desk on the floor.

A substantially rectangularly shaped top 38 is supported on the upper portion 14 of the frame 12. The top includes an upper surface 40 and a lower surface 42. In its normal configuration, as shown in FIG. 1, the top 38 is substantially horizontal. As indicated previously, however, the top 38 is capable of being pivoted into a vertical position such as shown in FIG. 3.

As shown most clearly in FIG. 3, the undersurface 42 of the top 38 includes a pair of rails 44 and 46 that extend from the upper end of the top 38 (as viewed in FIG. 3) to a point just below approximately half of the length of the top. A rod 48 is connected to the lowermost ends of the rails 44 and 46 and extends between them. As shown in FIG. 3, the rod 48 is positioned to ride in and is movable within the opening 50 defined by the guide or support member 52.

While not specifically shown in the drawings, the far end (the right side as viewed in FIG. 3) of the support member 52 is closed so that the rod 48 cannot be moved past the right end 22 of the frame 12. Similarly, a stop member 54 prevents the rod 48 from moving to the left as viewed in FIG. 3 beyond a certain point.

Also attached to the undersurface 42 of the top 38 is a pair of slide bolts 56 and 58. The slide bolts 56 and 58 are located adjacent either side edge of the top 38 and can be slid between positions where they are essentially hidden beneath the top 38 and where they extend out beyond the edges of the top 38 as shown in FIG. 3.

Mounted to the wall at locations just outside of the door frame of a doorway 60 is a pair of catch plates or keepers 62 and 64. When the desk 10 is moved or slid over into position so that the top 38 blocks the doorway 60, the slide bolts 56 and 58 are extended outward so as to engage the keepers 62 and 64.

The door blocking desk 10 is used in the following manner. In its normal position, the top 38 is horizontal as shown in FIG. 1 and the desk 10 can function as a conventional school desk or the like used by a teacher. Parenthetically, while the term "desk" is being used generally to describe the piece of furniture 10, it should be readily apparent that this could also be a table or other similar piece of furniture; the only requirement being that there be a horizontal top such as shown at 38 that is mounted on a frame or the like with legs. Thus, while the term "desk" is being used in this description, it should be interpreted to include substantially any piece of furniture that meets the above requirements.

When it is desired to block a doorway, the top 38 is slid to the right as shown in the figures into the position shown in FIG. 2. It is then pivoted upwardly to the position shown in FIG. 3 and then the entire desk 10 is slid into position so that the top 38 blocks the doorway and the slide bolts 56 and 58 are moved outwardly to engage the keepers 62 and 64.

As should be readily apparent to those skilled in the art, the slide bolts 56 and 58 and the keepers 62 and 64 are only one possible way of securing the top 38 to the door frame 60. Other types of locking mechanisms could also be used. Magnetic locks, for example, are frequently used in construction to securely hold panels together. Other equivalent locking devices could also be employed. In all cases, however, the lock must be operable from only the undersurface 42 of the top 38. Otherwise, an intruder could unlock the top from the exterior of the doorway.

Furthermore, while the top 38 bolted to the doorway may effectively prevent a person from entering, a standard table or desktop would not prevent bullets from passing through. Accordingly, it is preferable that the top 38 be comprised of or include a layer of bullet-proof material. Such bullet-proof material for tables or desktops or the like is clearly described in U.S. Patent Application Publication No. 2012/0152096 to Peters, published on Jun. 21, 2012. The entire subject matter thereof is incorporated herein by reference.

Figure 4:
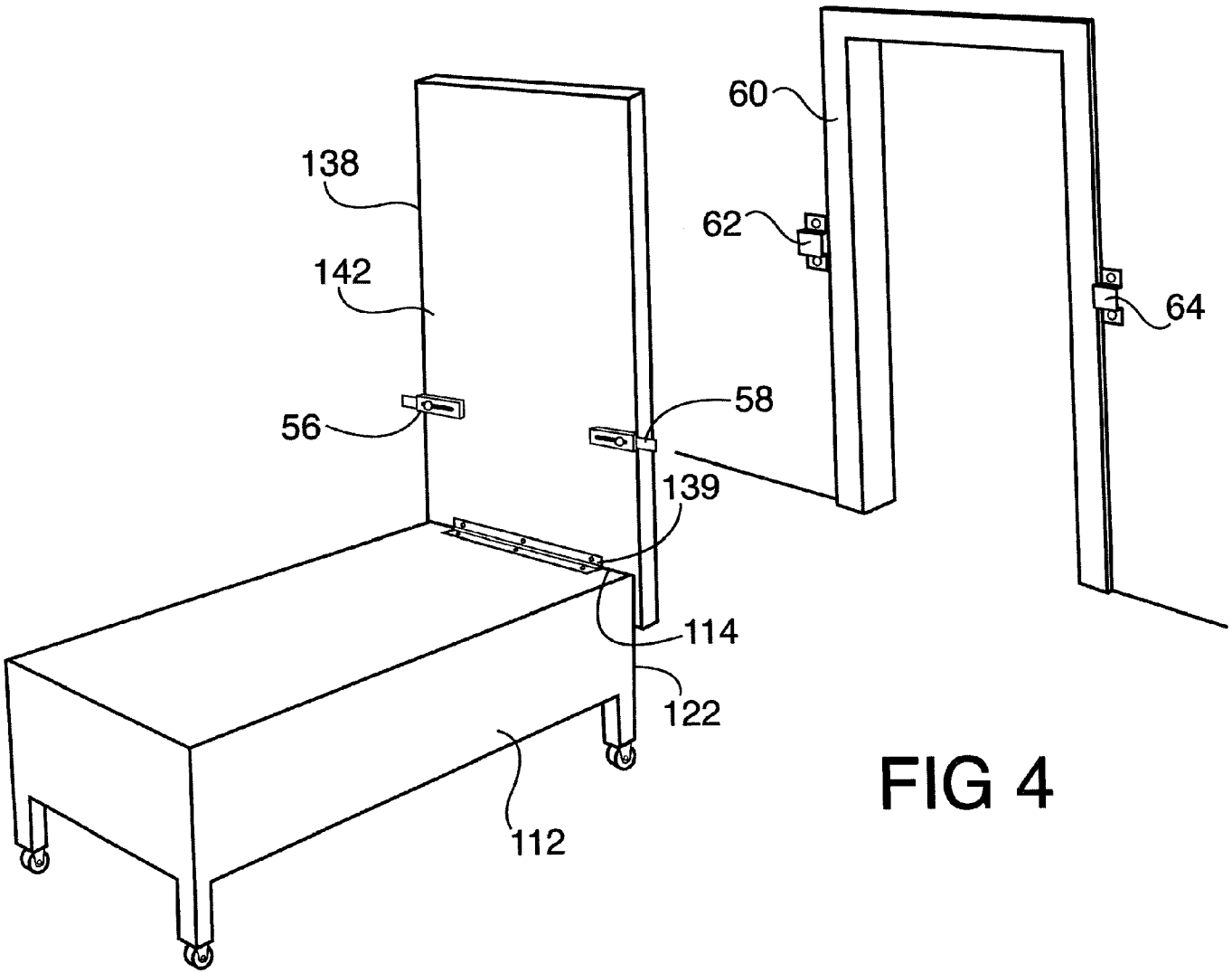
FIG. 4 is a front top perspective view similar to FIG. 3 but illustrating a second embodiment of the invention.

In a second embodiment of the invention as shown in FIG. 4, the top 138 does not slide before it is lifted into its vertical position. Rather, the underside 142 of the top 138 includes a hinge 139 attached thereto and to the upper portion 114 of the frame 112 adjacent the end 122 of the frame 112. In this embodiment, it is only necessary to lift the top 138 into its vertical position as shown in FIG. 4. Obviously, the top 138 will also be made of bullet proof material. Similarly, the end wall 122, which will also be blocking the doorway may also be made of bullet proof material.

To make it easier to lift the top 138, it may be beneficial to add hydraulic lifters or the like between the top and the frame of the desk. Such lifters, are per se, well known and are widely used to assist in the raising of automobile hoods and trunk lids. Hydraulic lifters could, of course, be used with either embodiment of the invention described above.

The present invention may be embodied in other specific forms without departing from the spirit or essential attributes thereof and accordingly, reference should be made to the appended claims rather than to the foregoing specification as indicating the scope of the invention.

I claim:

1. An article of furniture including:

a substantially rectangular frame including an upper portion, two sides and two ends and having four corners;

a leg extending downwardly from said frame at each corner and supporting said frame on the floor and a wheel located at the bottom of each leg;

a substantially rectangularly shaped normally horizontally oriented bullet-proof top supported on said upper portion of said frame, said top having an upper surface and a lower surface;

hinge means associated with said top and said frame whereby said top can be pivoted between a first position wherein it is horizontal and lying on said frame and a second position wherein it lies in a substantially vertical plane, said top being in substantial alignment with one of said frame ends when it is in its second vertical position;

said article of furniture being movable toward a doorway so that said upper surface of said top can block said doorway when said top is in its second vertical position, and locking means carried by said top and being located on said lower surface of said top, said locking means being operable from said lower surface of said top and being adapted to lock said top to the door frame of said doorway.

2. The article of furniture as set forth in claim 1 wherein said entire top is capable of sliding horizontal movement before it is pivoted into its second vertical position.

3. The article of furniture as set forth in claim 2 wherein a portion of said top lies below the level of said upper frame portion when said top is in its second vertical position.

4. The article of furniture as set forth in claim 1 wherein said article of furniture is a desk.

5. The article of furniture as set forth in claim 1 wherein said article of furniture is a table.

* * * * *